United States Patent [19]

Kranz

[11] Patent Number: 4,681,283

[45] Date of Patent: Jul. 21, 1987

[54] APPARATUS FOR CORRECTING THE FLIGHT PATH OF A MISSILE

[75] Inventor: Walter Kranz, Taufkirchen, Fed. Rep. of Germany

[73] Assignee: Messerschmitt-Bölkow-Blohm GmbH, Munich, Fed. Rep. of Germany

[21] Appl. No.: 765,332

[22] Filed: Aug. 13, 1985

[30] Foreign Application Priority Data

Aug. 13, 1984 [DE] Fed. Rep. of Germany ..... 3429798

[51] Int. Cl.[4] ..... F42B 15/033

[52] U.S. Cl. ..... 244/3.22

[58] Field of Search ..... 244/3.22

[56] References Cited

U.S. PATENT DOCUMENTS 4,463,921 8/1984 Metz ..... 244/3.22

4,522,357 6/1985 Bains et al. ..... 244/3.22

4,573,648 3/1986 Morenus et al. ..... 244/3.22

4,589,594 5/1986 Kranz ..... 244/3.22

*Primary Examiner*—Jordan Charles T.

*Attorney, Agent, or Firm*—Toren, McGeady & Associates

[57] ABSTRACT

An apparatus for correcting the flight path of a missile, such as a high speed shell or projectile, includes a missile body with a distributor for flow means rotatable in the missile body. An outlet opening for the flow means from the distributor is positionable relative to a blow-out opening on the outer circumference of the missile body for effecting a correcting thrust and for switching rapidly between different transverse forces, a missile tip provided with the blow-out openings is arranged to communicate with the outlet openings from the distributor. The extent to which the blow-out openings and the outlet openings align or overlap can be adjusted by a drive for the distributor acting in cooperation with the braking arrangement.

15 Claims, 14 Drawing Figures

APPARATUS FOR CORRECTING THE FLIGHT PATH OF A MISSILE

BACKGROUND OF THE INVENTION

The invention is directed to an apparatus for correcting or adjusting the flight path of a missile, such as a high-speed shell or projectile. The missile includes a missile body containing a distributor of a flow means rotatably mounted in the missile body. The distributor has at least one outlet opening for the flow means for effecting a transverse force on the missile body. At least one blow-out opening in the circumferential surface of the missile body is alignable with the outlet opening. A braking means acts between the distributor and the missile body.

In the applicant's German patent document No. P 33 17583.7-15, not previously published, a thrust nozzle system is disclosed which can be used to control a high-speed shell or projectile. The thrust nozzle system includes a rotary nozzle member acted upon by a gas generator or producer so that it is driven by the gas flow from the gas generator. The housing of the shell has a plurality of blow-out openings distributed around its circumference so that the gas flow from the rotary nozzle member can be directed in a controlled manner. A braking arrangement, which can be actuated electromagnetically, controls the rotary nozzle member. The high speed rotary nozzle member which could also be driven by a separate rotary drive, can be stopped with the aid of the braking arrangement to direct the gas jet in a determined direction. The direction of the gas jet in space can be varied by alternating between releasing and applying the braking arrangement.

Due to the arrangement of the rotary nozzle member and the blow-out opening on the circumference of the shell housing, with this system only substantially full commands or zero commands can be achieved. Such a procedure is sufficient, as a rule, since the changeover from a full command to a zero command or from a full command in one direction to a full command in the other direction is only slight because of the high-speed rotary nozzle member. If the flight path of the shell is to be corrected only slightly, that is, if a low pulse is to be introduced in a determined normal direction, a correspondingly high-speed control must be provided for the rotary nozzle member.

SUMMARY OF THE INVENTION

Therefore, the primary object of the invention is to provide an apparatus for the sensitive adjustment or correction of the missile flight path with a metered thrust.

In accordance with the present invention, a blow-out opening in the missile body is formed in a missile part which can rotate independently of the distributor. Means are provided for rotating the distributor and the outlet opening and the blow-out opening are at least partially alignable in a controlled manner by the means for rotating the distributor and by the braking arrangement.

In an apparatus embodying the present invention, the blow-out openings are provided, in a rotating missile tip on the missile body or in another rotating part, for instance, a cylindrical region at the trailing end of the missile. The missile tip is driven independently from the flow means distributor, that is, by small obliquely angled fins, by a spring means or by explosive charges.

The distance travelled by the flow means distributor in switching from a full command to a zero command, or from a command of a predetermined strength to a command altered in a dosed manner, are substantially reduced in accordance with the invention. The commands can be very sensitively adjusted by the degree of overlap or partial alignment of the blow-out opening in the missile body and the corresponding outlet opening in the distributor. The extent of the overlap of the openings is adjustable in a controlled manner.

A very simple embodiment of the apparatus, in accordance with the present invention, is provided when the flow means distributor is constructed as a propelling nozzle member driven rotatably by gas flow and including two propelling nozzles arranged off-center and acting in opposite directions and corresponding to two opposite radially directed blow-out openings in the missile tip. During a zero command, the overlap of the nozzles is 50% and can be varied in a determined direction by accelerating or braking the propelling nozzle member to achieve a dosed thrust command. As long as the braking arrangement is not effective, the propelling nozzle member rotates at a higher speed than the nozzle tip so that, proceeding from the state of zero command, when releasing the brake the rotary nozzle member runs ahead of the missile tip and, accordingly, one nozzle receives a greater overlap while the overlap of the other nozzle is reduced. If, starting from the same initial state, the brake is applied, the overlap changes in the opposite direction. In this way by correspondingly controlling the propelling nozzle member, for instance by a pulse duration modulation, a very accurately dosed command can act in a desired direction.

As mentioned above, the rotary drive for the propelling nozzle can be effected by a gas flow, such as from a gas generator. It is also possible to provide the rotary drive by ram air with the ram air also used as control air. Other combinations are possible, for instance, separation of the rotary drive and the production of the control air.

In the independent drive of the missile tip, the moment of inertia of the rotating missile tip should be substantially greater than that of the elements providing the feed of the flow means and its distribution, so that a stable movement of the missile tip is achieved.

A zero command can be produced in a number of ways. If the flow means distributor has only one outlet opening, that is, one propelling nozzle, and the missile tip has only one corresponding blow-out opening, it is possible to attain the zero command by continuously circulating a thrust jet of uniform strength. Hardly any disturbance will occur for the missile if the rotational speed of the missile tip is sufficiently high.

If two corresponding openings are provided in the flow means distributor and in the missile tip, which are aligned as indicated above, then two oppositely directed circulating thrust jets act during a zero command with an overlap of 50% of the corresponding openings, so that practically no disturbances occur on the missile.

Moreover, it is also possible to provide a single opening in the flow distributor means with a plurality of blowout openings distributed over the outer circumference of the missile tip. Between the blow-out openings in the missile tip, impact or deflecting surfaces are provided so that—in the case of ram air as control gas—the opening in the flow means distributor is blocked or—when a gas generator is used—the gas jet from the flow means distributor impacts without reaching the outside atmosphere. The gas jet can be guided away through a collecting duct. In addition, spring stops can be used for the flow means distributor with the distributor running up against the spring stops and thus being held in a position where the gas jet is directed against the impact of the deflecting surfaces. The braking arrangement is released when this occurs and the position between the missile tip and the flow means distributor is maintained to afford zero command. By braking the flow means distributor, the angular position between the distributor and the missile tip is altered so that the gas jet can flow out from the adjacent blow-out opening of the missile tip, specifically with more or less strength according to the amount of overlap. The spring stops can be overrun when the flow means distributor and the missile tip are rotated in opposite directions.

In a preferred embodiment of the invention, the rotary drive for the flow means distributor can be provided by a spring drive connected between the missile tip and the distributor. In the simplest case, the spring drive is a simple pretensioned coil spring. When the flow means distributor is braked, that is, from the position assigned to a zero command, the spring is tensioned. When the brake is subsequently released, the distributor is accelerated in the same direction as the rotating missile tip due to the stored spring energy and thus runs ahead of the tip. By a corresponding control, such as by a pulse with modulation, the thrust vector can be determined in strength and spatial direction.

The construction of the rotary drive for the flow means distributor with the aid of a spring drive has the advantage that the energy necessary for the operation of the drive is applied directly from the independently driven missile tip. The outlet nozzle of the flow means distributor can be arranged so that it is symmetrical relative to the rotational axis in the flow means distributor and affords a simple and safe construction.

To establish the direction and strength of the thrust, a control circuit is provided for establishing the relative angular positions of the openings from the flow means distributor and the missile tip with regard to the rest of the missile body. The information on this angular position can be obtained in a simple manner by angle transmitters, such as potentiometers, located on one hand between the missile body and the rotating missile tip and, on the other hand, between the flow means distributor and the missile body. The output signals of these angle transmitters are processed in a differentiator circuit.

The advantages attained with an apparatus embodying the present invention can be summarized as follows:

A very fast pulse change, that is, a very fast change in the strength and direction of the thrust, is obtained by the rotating missile tip. Moreover, the thrust is adjustable in a very sensitive manner.

The required spatial direction for a thrust pulse is quickly achieved by the independent rotation of the missile tip, that is, the missile tip determines the basic direction for the control thrust, and the modulation of the thrust is effected through the control mechanism. Basically, with this arrangement, there is an abbreviated dead time for the realization of the command.

In the arrangement of the apparatus, according to the present invention, with two openings in the flow means distributor and in the missile tip when a gas generator is used for producing the thrust jet, the bearing load of the parts involved with the flow means feed is also reduced.

Command pulses, that is, the product of the transverse force or thrust multiplied by time, are obtainable with reduced transverse force, since the thrust can be sensitively adjusted. As a result, unnecessarily high transverse forces which might negatively influence the missile flow path, are not produced.

Considerable miniaturization of the entire flow means feed is provided especially in the construction with a spring drive or friction drive for the flow means distributor.

The rate of rotation of the missile around its elongated central axis can vary widely in all of the different embodiments of the invention, accordingly, the apparatus can be used for rotating as well as non-rotating missiles.

In every embodiment of the apparatus, according to the invention, the gas flow rate through the flow distributor means is identical in all types of command to the extent possible, that is, the gas generator operates in a constant manner. During zero command, in each instance, 50% of the mass flow rate passes through two oppositely disposed locations and a stepless transition can be effected from zero command to full command. A zero command can also be achieved by a neutral exhaust of the gas without exercising any externally acting forces.

When a spring drive is used for the flow means distributor, the spring is constructed as a stop and a full command can be given practically continuously in a determined spatial direction.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
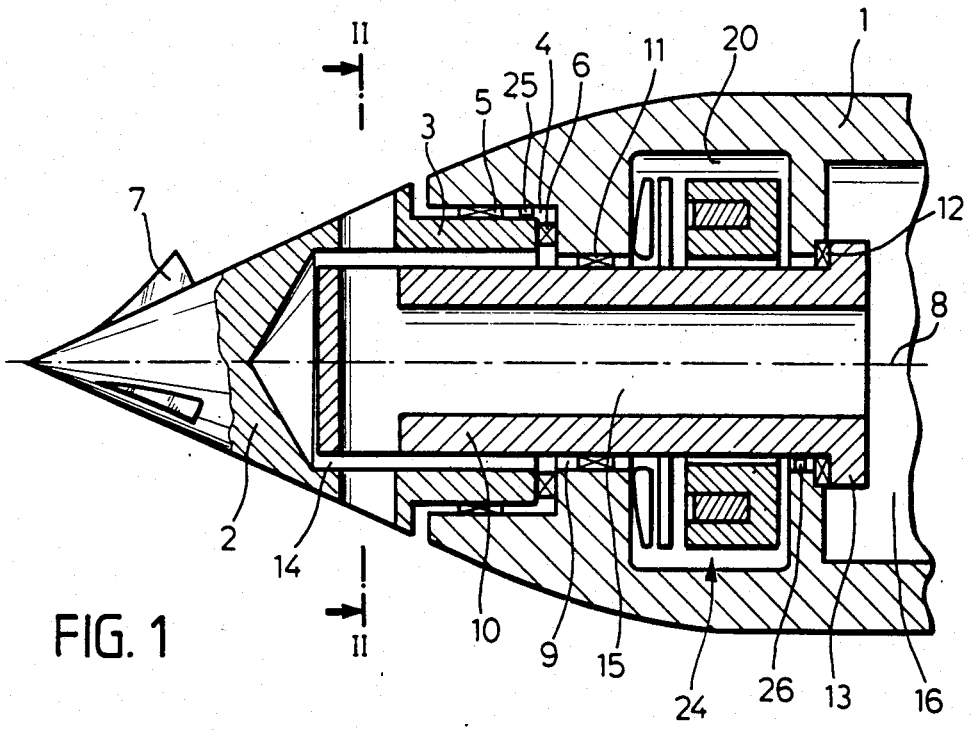
FIG. 1 is an axially extending section through the front part of a high speed missile incorporating apparatus, embodying the present invention, for correcting the flight path of the missile with the apparatus including a rotating missile tip and a driven brakeable flow means distributor.

FIG. 1 displays the front part of a missile 1, such as a high speed shell or projectile with a rotating missile tip 2. As viewed in FIG. 1 the left-hand end is the leading end of the missile and the missile tip and the right-hand end is the trailing end of the missile tip. Missile tip 2 is rotatably supported with a round flange or sleeve 3 in a recess 4 of the missile housing 1 extending rearwardly from the missile tip 2. The missile tip 2 has a plurality of fins 7 distributed around its outer circumference adjacent the leading end with the fins extending obliquely relative to the central axis 8 of the missile 1. During flight of the missile, the fins 7 pass through the atmosphere and provide fast rotation of the missile tip 2 around the central axis 8. In a centrally arranged borehole 9 within the missile body 1 a cylindrically shaped flow means distributor 10 is rotatably supported in the borehole 9 by radial guide bearings 11 and support bearings 12 at a trailing end flange 13 on the distributor. The flow means distributor 10 has an axially extending centrally arranged gas duct 15 open at the trailing end in the region of the flange 13 where it opens into a gas generator 16. At the opposite or leading end of the flow means distributor 10 located within the missile tip 2, the centrally arranged gas duct 15 opens into two off-center propelling or thrust nozzle 17-1, 17-2, note FIG. 2, arranged to direct flow in opposite directions in a radial plane with the openings disposed symmetrically relative to the central axis 8. Two blow-out openings 19-1, 19-2 are located in the missile tip 2 and are also positioned in a radial plane and are arranged relative to the nozzle 17-1, 17-2 through the nozzle openings 18-1, 18-2.

A braking arrangement 24 as disclosed in the German patent document No. P 33 17 583.7 is arranged about the flow means distributor 10 in the region of a recess 20 in the missile body 1. The braking arrangement 24 is actuated by a control circuit, not illustrated. The apparatus as shown in FIGS. 1 and 2 operates as follows:

Initially, the operation will be considered without the control circuit. During missile flight, the gas generator 16 is ignited and its gas jet flows through the central gas duct 15 in the flow means distributor 10 and then radially outwardly through the two propelling nozzles 17-1, 17-2. The gas jet drives the flow means distributor 10 in rapid rotation around the central axis 8 of the missile in the direction of the arrow P-1 in FIG. 2 (such rotation is effected only if the gas jet exits freely from the propelling nozzle 17-1, 17-2). At the same time, the missile tip 2 rotates in the same direction with the flow means distributor 10 as indicated by the arrow P-2, note FIG. 2.

Figure 2:
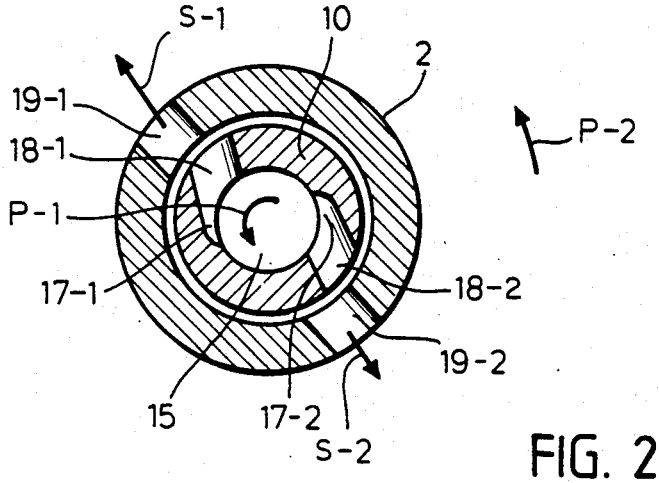
FIG. 2 is a sectional view taken along the line II—II in FIG. 1.

In FIG. 2 the relative angular position of the flow means distributor 10 and missile tip 2 during a zero command is displayed, that is, the period during which no transverse forces act on the missile 1 for correcting its flight path. In this position, the extent of the overlap or alignment between the nozzle openings 18-1, 18-2 and the corresponding blow-out openings 19-1, 19-2 is 50%, that is, in this position 50% of the gas jet exits into the atmosphere through each of the blow-out openings 19-1, 19-2. The oppositely directed and equal transverse forces provided in this condition are indicated by the vectors S-1 and S-2, respectively. This relative angular position between the flow means distributor 10 and the missile tip 2 is maintained by the control circuit during the rotation of the missile tip with the flow means distributor 10, in a control manner, being braked or released from braking by the braking arrangement 24 relative to the missile body. In such operation it is ensured that the possible rate of rotation of the flow distributor means 10 is higher than the rate of rotation of the missile tip 2. The control circuit receives information from two angle transmitters 25, 26, with one transmitter 25 arranged between the missile tip 2 and the missile body 1 and the other transmitter 26 positioned between the flow means distributor 10 and the missile body 1. If a correcting thrust for adjusting the missile flight path in a determined spatial position is given, then the relative angular position between the flow means distributor 10 and the missile tip 2 is changed, with the aid of the control circuit, based on the angular relationship information received from the angle transmitters 25, 26 so that the overlapping or aligning relation of the nozzle openings 18-1, 18-2 and the blow-out openings 19-1 and 19-2 changes accordingly. If, for example, a correcting thrust is effected in a determined spatial relation through the blow-out opening 19-1, the braking arrangement is briefly applied, and proceeding from the state of the zero command illustrated in FIG. 2, as when the blow-out opening 19-1 is directed as desired. Accordingly, the flow means distributor is braked and the overlapping or partial alignment between the nozzle opening 18-1 and the blow-out opening 19-1 is increased. Simultaneously, the partial alignment between the nozzle opening 18-2 and the blow-out opening 19-2 is reduced when the correcting thrust is executed, the braking arrangement 24 is released and the flow means distributor accelerates again in the direction of the arrow P-1. When the position corresponding to a zero command in FIG. 2 is reached, this position is maintained via the control circuit by alternating between the release and the application of the braking arrangement 24. In the same manner a correcting thrust can be adjusted by the blow-out opening 19-2. The control for correcting thrust is effected with the aid of a pulse duration modulation.

Accordingly, if the braking device 24 is applied for a longer period than it is released, then the flow means distributor 10 lags behind the rotating missile tip, out of the position corresponding to zero command, with the blow-out opening conducting a larger amount of gas outwardly than the blow-out opening 19-2. Here, a correcting thrust acts in the direction of the arrow S-1 shown in FIG. 2. If, conversely, during the pulse duration modulation, the time of applying the braked arrangement is shorter than the release time, the flow means distributor 10 runs ahead of the rotating missile tip 2 so that a greater quantity of gas flow out through the blow-out opening 19-2 than through the blow-out opening 19-1. Under such a condition, a correcting thrust in the direction of arrow S-2 in FIG. 2 is achieved. The dosing of the correcting thrust is possible, in both angular directions from a position corresponding to zero command up to full command where the entire gas quantity flows out through only one blow-out opening and there is no gas exits in the other oppositely directed blow-out opening.

Additional embodiments of apparatus embodying the present invention for correcting the path of a missile are provided in FIGS. 3–12. In the various embodiments, which are identical or act identically to the embodiment shown in FIGS. 1 and 2 similar parts are designated with the same reference numerals but with the addition of a suffix letter, such as a, b, and the like.

Figure 3:
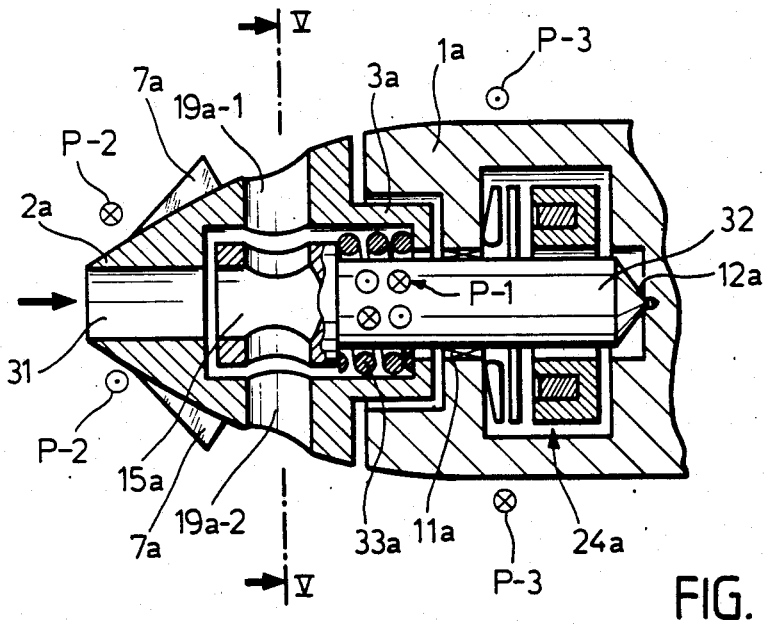
FIG. 3 is an axially extending sectional view through a front part of a missile illustrating another embodiment of the apparatus for corecting the missile flight path.

FIG. 3 shows the leading end of a missile 1*a* with a rotating missile tip 2*a* similar to the embodiment shown in FIG. 1. The missile tip 2*a* is supported in the missile body 1*a* in the same manner as in the previous embodiment and the missile tip rotates by the action of the flow of air over the fins 7*a* independently from the rotation of the flow means distributor 10*a* and of the missile 1*a*, respectively. The missile tip has two blow-out openings 19*a*-1 and 19*a*-2 which communicate with the nozzle openings 18*a*-1, 18*a*-2 of the flow means distributor 10*a*. The thrust jet for correcting the missile flight path is produced by ram air flowing through a central ram air duct 31 in the missile tip 2*a* into the gas duct 15*a* of the flow means distributor 10*a*, with the gas duct 15*a* being open at the leading end of the missile or missile tip. From the gas duct 15*a* the ram air flows out through two oppositely directed radial nozzle openings 18*a*-1, 18*a*-2. The flow means distributor could, it is true, be driven by a propelling nozzle arrangement corresponding to the embodiment in FIG. 1 by means of ram air, but another construction, explained later, is used.

A bearing shaft 32 rotatably supported in the missile body 1*a* by means of radial guide bearings 11*a* and a supporting bearing 12*a* in the form of a conical bearing, adjoins the propelling nozzle arrangement of the flow means distributor 10*a*. A braking arrangement 24*a* similar to the embodiment in FIG. 1, is used for the flow means distributor 10*a*. In this arrangement, it is generally assumed that the missile tip 2*a* rotates in the direction P-2, the missile body 1*a* rotates in the direction P-3 and the flow means distributor 10*a* rotates in the direction P-1 so that the relative rotational direction of the flow means 10*a* is adjustable in the opposite direction with respect to the missile tip 2*a* in a controlled manner by means of the braking arrangement 24*a*.

The "drive" of the flow means distributor 10*a* is afforded by a coil spring 33*a* made up of a plurality of windings tensioned or gripped in between the rotating missile tip 2*a* and the bearing shaft 32 of the flow means distributor 10*a* in the region of the round flange sleeve 3*a* of the missile tip 2*a*. During rotation of the missile tip 2*a*, the flow means distributor 10*a* is carried along in the following manner. When the braking arrangement 24*a* is applied, the coil spring 33*a* is tensioned. When the braking arrangement 24*a* is subsequently released, the flow means distributor 10*a* is accelerated in the same direction as the rotation of the missile tip 2*a* by the stored spring energy and runs ahead of the tip until the braking arrangement 24*a* is again applied. By alternating between applying and releasing the braking arrangement 24*a*, the relative angular position of the nozzle openings 18*a*-1, 18*a*-2 can be adjusted relative to the blow-out openings 19*a*-1, 19*a*-2 in the missile tip. The relative angular position between the flow means distributor 10*a* and the missile tip 2*a* is determined by the spring 33*a*. One position is defined with the tensioned spring acting against the flow means distributor 10*a* and the other position is defined when the expanded spring bears against the round flange 3*a* of the missile tip 2*a*. Two oppositely wound coil springs could also be used as a spring drive.

The operation of the embodiment shown in FIG. 3 is explained, along with the embodiment illustrated in FIG. 4, below with the aid of FIGS. 5*a*–5*c*.

Figure 4:
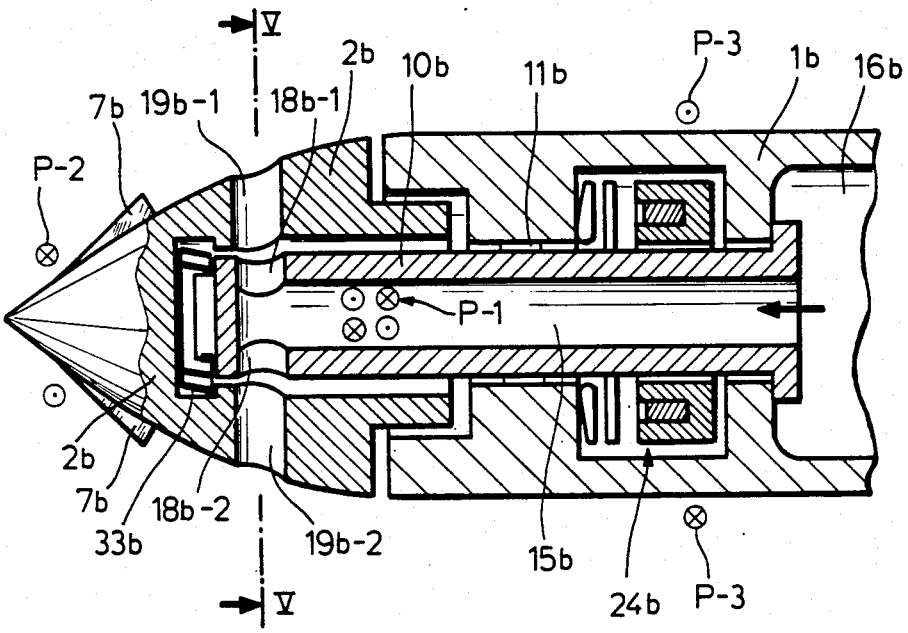
FIG. 4 is an axially extending section through a front part of the missile with still another embodiment of the present invention used for correcting the flight path.

FIG. 4 also shows the leading end of a missile 1*b* with a rotating missile tip 2*b* which is rotated by the fins 7*b*. The support of the missile tip 2*b* and the missile body 1*b* is the same as described for the above embodiments. The cylindrical flow means distributor 10*b* is supported in the missile body 1*b* in the same manner as in the embodiment in FIG. 1. A gas generator 16*b*, corresponding to FIG. 1, is provided for the flow means distributor 10*b*. The gas flows through a central gas duct 15*b* of the flow distributor means and flows outwardly through the radially arranged nozzle openings 18*b*-1, 18-*b*2. The gas jet can then exit through the corresponding blow-out openings 19*b*-1, 19*b*-2 in the missile tip 2*b* to produce a transverse force.

For the "drive" of the flow means distributor 10*b* relative to the rotating missile tip 2*b*, a wound leaf spring 33*b* is located under tension between the leading end of the flow means distributor 10*b* and the missile tip 2*b*.

A braking arrangement 24*b* constructed in the same manner as in the previously described embodiments, is provided for the flow distributor means 10*b*.

In the embodiment shown in FIG. 4, the gas flow from the gas generator 16*b* is not used for the drive of the flow means distributor 10*b*, or if so then only in an insubstantial manner.

Figure 5A:
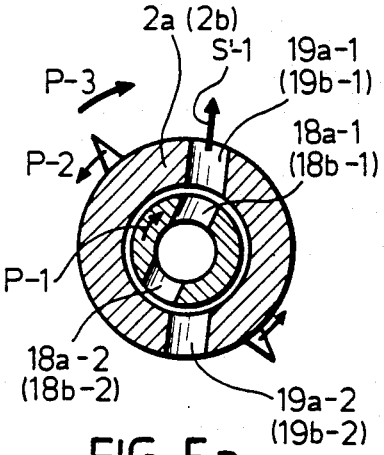
FIGS. 5*a*, 5*b* and 5*c* are transverse, sectional views taken along the lines V—V in FIGS. 3 and 4 for the purpose of explaining the operation of the apparatus embodying the invention.
Figure 5B:
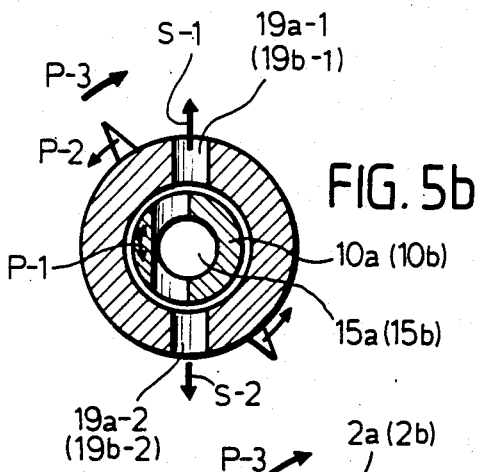
Figure 5C:
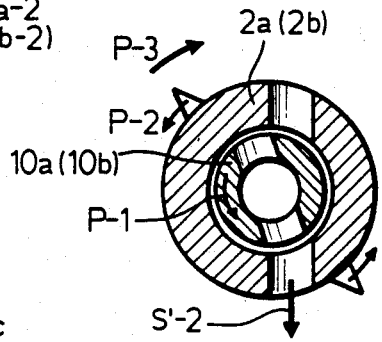

FIGS. 5*a*–5*c* illustrate cross-sections through a missile in the region of the blow-out opening 19*a*, 19*b*, respectively, based on the embodiments set forth in FIGS. 3 and 4. It can be seen in FIGS. 5*a*–5*c* that the blow-out openings 19*a*-1, 19*b*-1 and 19*a*-2, 19*b*-2 are oppositely directed and extend approximately radially. During a zero command, the amount of overlap or alignment between the blow-out openings 19 and the nozzle openings 18 (18*a*-1, 18*b*-1, 18*a*-2, 18*a*-2) of the flow means distributor 10*a*, 10*b* is 50% so that oppositely directed transverse forces S-1 and S-2 of identical size are produced. These transverse forces S-1, S-2 are maintained by corresponding control of the flow means distributor during the rotation of the missile tip, the flow means distributor and the missile body. The missile body and the flow means distributor rotate in the same direction at the same rotational speed. When starting from zero command, the braking arrangement 24*a*, 24*b* is applied, and the flow means distributor lags in its rotation relative to the missile tip. This lagging action takes place, for example, until the nozzle opening 18*a*-1 (18*b*-1) corresponds with the cooperating blow-out opening 19*a*-1 (19*b*-1), according to FIG. 5*a* with the nozzle opening 18*a*-2 (18*b*-2) being blocked. Accordingly, a transverse force S'1 is produced for correcting the missile flow path. On the other hand, preceding from a zero command according to FIG. 5*b*, if the braking arrangements 24*a* (24*b*) is released, the flow means distributor 10*a* (10*b*) is accelerated in the same direction as the rotation of the missile tip by the energy stored in the spring drive. This can take place to the extent shown in FIG. 5*c*. In this angular position between the flow means distributor and the missile, the nozzle opening 18*a*-2 (18*b*-2) communicates fully with the blow-out opening 19*a*-2 (19*b*-2), while the respective radially opposite nozzle opening is completely closed. Under this condition, a radially acting transverse force S'2 is achieved for correcting the missile flight path.

Of course, all possible intermediate positions between the zero command and the indicated full command are possible. The arrangement of the individual openings in the flow means distributor and in the missile tip are set forth in FIGS. 5*a*–5*c* only by way of example. Other configurations are possible in addition to the laterally offset arrangement of the individual openings with respect to the central axis of the missile shown in FIGS. 5*a*–5*c*, as long as it is ensured that, during a zero command, the overlap extent is approximately 50% and the possibility exists of changing the overlapping arrangement up to a full command.

Figure 6:
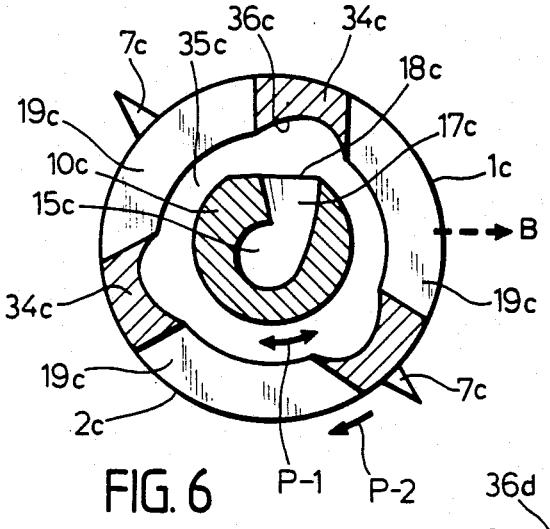
FIG. 6 is a transverse cross-sectional view of yet another embodiment of an apparatus incorporating the present invention.

FIG. 6 shows a cross-section through a missile 1*c* in the region of the blow-out openings of the missile tip 2*c* which rotates independently due to the action afforded by the fins 7*c*. The flow means distributor 10*c* is driven either by a gas generator as shown in FIG. 1 or by ram air as shown in FIG. 3. The flow means distributor 10*c* includes a single propelling nozzle 17*c* arranged off-center and branched off from a central gas duct 15*c* with a nozzle opening 18*c* from the duct. The flow means distributor 10*c* can be rotated by alternating between applying and releasing a braking arrangement, not shown, in its angular position relative to the missile tip rotating in direction P-2, in both directions corresponding to the double arrow P-1.

The rotating missile tip 2*c* has three blow-out openings 19*c* equiangularly distributed over the circumference of the tip and, in each instance, the openings extend over an angle of approximately 90° and are spaced form one another by separating webs 34*c*.

A relatively wide open space 35*c* is located between the flow means distributor 10*c* and the shell tip 2*c*. The separating webs 34*c* serve as impact and deflecting surfaces and, in each instance, comprise a concave recess 36*c* facing the flow means distributor 10*c*. For a zero command, the flow means distributor 10*c* is held, by the control circuit, not shown, in the position illustrated in FIG. 6, relative to the rotating missile tip 2*c*, in which position the gas jet exiting from the propelling nozzle 17*c* impacts against the concave recess 36*c* of the oppositely located separating web 34*c*. The gas flowing out of the propelling nozzle 17*c* is deflected by the concave recess 36*c* and is distributed uniformly into the open space 35*c* and flows into the atmosphere in equal portions through the three blow-out openings 19*c*. The sum of the transverse forces is zero, accordingly, the flight path of the missile 1*c* is not influenced. As is possible in the embodiments described above, the angular position of the flow means distributor 10*c* relative to the rotating missile tip 2*c* is held for a zero command in the position illustrated in FIG. 6 with the movement of the flow means distributor 10*c* being controlled, that is, by a pulse width modulation, or with the braking force applied by the braking arrangement being changed more or less continuously. In both cases, there is a bearing control of the rotating flow means distributor relative to the missile tip.

If, in the embodiment displayed in FIG. 6, a transverse force is produced in direction B, the braking arrangement is actuated and the propelling nozzle 17*c* is stopped in a position where the thrust direction points in the direction B. Since the missile tip 2*c* continues to rotate, a transverse force is produced in the direction B as soon as the separating web 34*c* releases the thrust jet of the propelling nozzle 17*c*. When the braking arrangement is again released, a partial command or a full command is brought about so that the full command acts during the time in which the missile tip rotates past the propelling nozzle 17*c* over the angular region of the subsequent blow-out opening 19*c*. If the partial or full command is interrupted, then either the braking arrangement for the flow means distributor 10*c* is released with the distributor being accelerated, as soon as the thrust jet impacts on the separating shoulder 34*c* which runs in advance, then the movements of the missile tip and the flow means distributor are coordinated so that a zero command is established, or, particularly in the long acting full command, the rotating means distributor 10*c* is braked until the gas jet from the propelling nozzle 18*c* impacts on the following separating web 34*c* so that a zero command is present. From this moment the rotational movements of the flow means distributor and the missile tip are again coordinated.

This embodiment has the advantage that a quasi-continuous full command can be set in a predetermined direction, for instance the direction B as shown. In addition, the rotating flow means distributor 10*c* is always held so that its gas jets act in the direction B. The transverse force produced is interrupted only when the separating webs 34*c* of the missile tip run past the propelling nozzle 17*c*. If the flow means distributor is fed by a gas generator, a higher utilization coefficient of the gas generator is effected.

Figure 7:
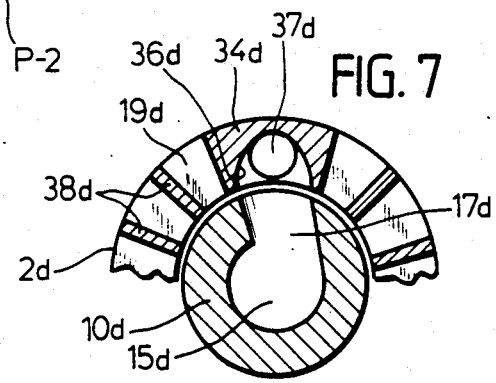
FIG. 7 is a partial transverse view through a modified embodiment with regard to the arrangement illustrated in FIG. 6.

The embodiment of the apparatus for correcting a missile flight path, shown only partially in FIG. 7, operates according to the same principle as the embodiment in FIG. 6. Instead of providing an open space between the flow means distributor 10*d* and the rotating missile tip 2*d*, a collecting duct 37*d* is provided in the region of the concave recesses 36*d* so that the gas flowing from the propelling nozzle 17*d* enters the collecting duct 37*d* and is conducted away in a directionally neutral manner. The collecting duct 37*d*, including the diverse ducts, not shown, extending to the gas exhaust from the missile, has a clearly lower resistance than the gas discharge nozzle at the flow means distributor for ensuring a virtually constant mass throughput for the total command functioning period. Only a slight gap remains between the flow means distributor 10*d* and the missile tip 2*d*. The gas generator is better utilized in this arrangement. The outlet opening 19*d* separated from one another by webs 34*d*, are divided by the webs 38*d* for better flow guidance of the thrust jet from the propelling nozzle.

Figure 8:
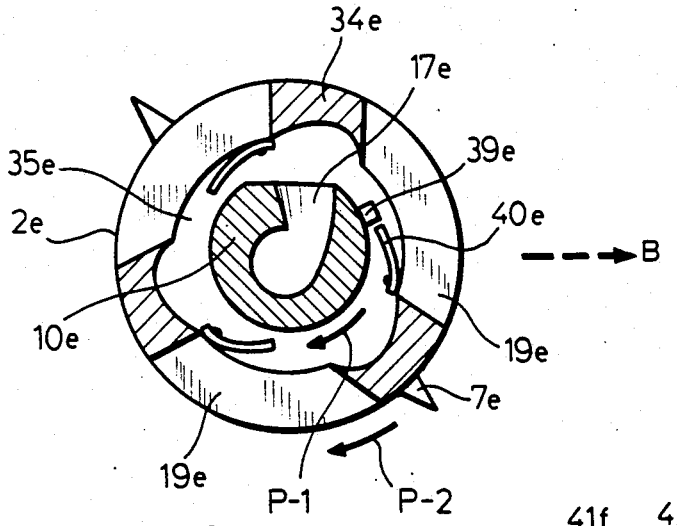
FIG. 8 is a transverse cross-sectional view through still another embodiment of apparatus incorporating the present invention for correcting the flight path of the missile.

In the embodiment of FIG. 6, the rotating flow means distributor can be accommodated opposite the separating web so that it either leads or lags with respect to the rotating missile tip for producing a zero command. In the embodiment of FIG. 8, it is only possible to switch from a zero command with leading action of the rotating flow means distributor 10*e*. The flow means distributor 10*e* comprises a single propelling nozzle 17*e* arranged off-center and separated from the rotating nozzle tip 2*e* by an open space 35*e*. In this arrangement a construction corresponding to FIG. 7 would be possible. The flow means distributor 10*e* is driven in the direction of the arrow P-1 by the gas generator or by ram air.

The missile tip rotating in the direction P-2 is provided with fins 7*e* and, as in the embodiment of FIG. 6, includes three wide blow-out openings 19*e* separated from one another by webs 34*e*.

At the flow means distributor 10*e*,a stop 39*e* is positioned for cooperating with spring stops 40*e* mounted on the rotating missile tip 2*e*. Three spring stops 40*e* are provided and, in each instance, they are arranged so that when releasing the braking arrangement, not shown, the high-speed flow means distributor 10*e* runs up against a corresponding spring stop 40*e* with its stop 39*e* and secures the propelling nozzle 17*e* in a position so that the gas jet flowing from the propelling nozzle 17*e* impacts against a separating web 34*e*. The relative angle between the flow means distributor 10*e* and the rotating missile tip 2*e* is maintained as long as the braking arrangement is released. The resulting command is a zero command. In contrast to the above embodiment, a control of the rotation of the flow means distributor 10*e* for maintaining zero command is not necessary. If a partial or full command is given in the direction B, the flow means distributor 10*e* is held by the braking arrangement so that the thrust jet acts in the direction B. If the command is cancelled by releasing the braking arrangement, the flow means distributor 10*e* accelerates until it runs up against the spring stop 40*e* in the leading direction and a zero command is again established. If a full command in direction B is to be maintained for a longer period of time, it can be effected in the same manner as in the embodiment shown in FIG. 6. The spring stops 40*e* are constructed so that they can override the stop 39*e* on the flow means distributor 10*e* during the rotation of the missile tip in the direction P-2.

Figure 9:
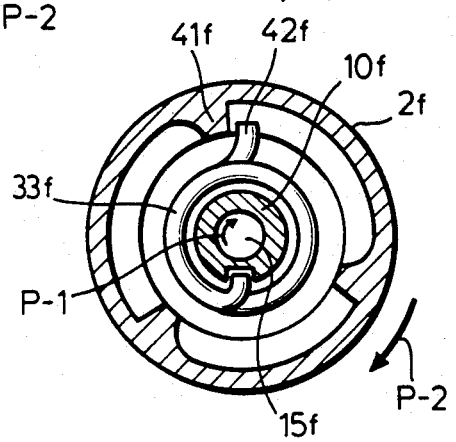
FIG. 9 is a transverse cross-sectional view through a missile tip and a flow means distributor connected with the missile tip by a spring drive.
Figure 10:
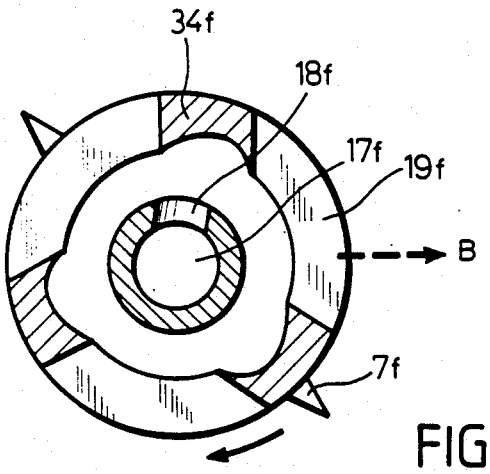
FIG. 10 is a transverse cross-sectional view through an apparatus embodying the present invention for correcting the flight path of the missile corresponding to FIG. 9 at the height of the outlet openings of the flow means distributor.

FIGS. 9 and 10 display another embodiment of an apparatus for correcting a missile flight path with a modified spring drive for the flow means distributor 10*f*.

It is assumed that the flow means distributor 10*f* is supplied by a gas generator corresponding approximately to the embodiment shown in FIG. 4. The cylindrical flow means distributor 10*f* has only one nozzle 17*f* which opens into a radial nozzle opening 18*f*. In the region of the leading end of the cylindrical flow means distributor 10*f*, a spring drive is provided, similar to the one in FIG. 4, and it consists of a coil spring 33*f* clamped between the rotating missile tip 2*f* and the flow means distributor 10*f*. This clamping action is, however, not fixed on the missile tip 2*f* but rather, three stops 41*f* for one end 42*f* of the coil spring 33*f* with the spring end 42*f* bent outwardly toward the missile tip, are provided within the missile tip. The stops 41*f* are formed so that with the release of the braking arrangement, the flow means distributor 10*f* is carried along by the bent spring end 42*f* and rotates along with the missile tip in the direction P2 at the same rate of rotation.

FIG. 10 portrays the angular position between the flow means distributor 10*f* and the missile tip 2*f* during common rotation. The missile tip 2*f* has three circumferentially spaced blow-out openings 19*f* separated by webs 34*f*. The missile is constructed in the region of the blow-out openings 19*f* in correspondence with FIGS. 6 or 7. In FIG. 10 a construction corresponding to FIG. 6 is used. Accordingly, as long as the braking arrangement is released and the flow distributor 10*f* is carried along in the rotation of the missile tip 2*f*, the gas jet from the propellent nozzles 17*f* runs against a web 34*f* so that a zero command is present. If a command is given in the direction B the flow means distributor 10*f* is then braked and stopped when the gas jet points in the direction B. The gas jet from the nozzle opening 18*f* still runs up against the web 34*f* during this time. Next, however, the missile tip 2*f* continues to rotate and the gas jet flowing out of the blow-out opening 19*f* trailing the separating web 34*f* flows out in direction B so that an opposite transverse force is produced for correcting the missile flow path.

During continued rotation of the missile tip 2*f*, coil spring 33*f* is tensioned and stores energy. If, for example, only a short partial command is given in the direction B extending only a small angular rotation of the missile tip 2*f*, then the braking arrangement is released at the end of the partial command. The flow means distributor 10*f* is rotated by the stored spring energy in the direction of rotation P-2 of the missile tip 2*f* until the nozzle opening 18*f* again is aligned opposite a web 34*f* which is running ahead. Again the zero command is present, and the flow means distributor 10*f* is carried along in rotation by the missile tip, as described above.

If the command is to act over a longer period of time, the braking arrangement is applied for a corresondingly longer time. During braking of the flow flow means distributor 10*f*, coil spring 33*f* is tensioned, as described above until the bent end 42*f* of the spring overrides the stop 41*f* on the side of the missile tip 2*f* during the continued rotation of the missile tip 2*f*. The coil spring 33*f* relaxes until the next stop 41*f* on the side of the missile tip 2*f* runs against the bent end 42*f* of the coil spring. The full command can be maintained either by the continued braking of the flow means distributor in the fixed spatial position B, where the coil spring 33*f* alternately is under tension and relaxes, or the full command can be terminated by releasing the braking arrangement. The coil spring which, as a rule, is tensioned up until this time, accelerates the flow means distributor 10*f* in the direction P-2 until the nozzle opening 18*f* again trails behind a web 34*f*. If the coil spring is already relaxed precisely when the full command is interrupted, because the bent end 42*f* has contacted a stop 41*f*, then the end is carried along with the stop 41*f* and the zero command again results. The dead time between full command and zero command is increased, however, though only slightly, by means of this second possibility. Such dead time can be shortened in a transition, via the control circuit, from full command to partial command when the coil spring 33*f* is tensioned. The control circuit is operated by information on the changeover criterion by corresponding angle transmitters between the missile tip, the flow means distributor and the missile body, as explained in the description of the embodiment in FIG. 1.

In principle, the rotational directions of the missile tip, the flow means distributor and the missile itself can be independent of one another in all of the embodiments, since the rotary drive for the full means distributor can be adjusted in all of these embodiments. A regulation of the angular position of the flow means distributor in the embodiments shown in FIGS. 8–12 is desirable, but is not absolutely necessary, since the flow means distributor always runs automatically into a position corresponding to a zero command when the braking arrangement is released.

Figure 11:
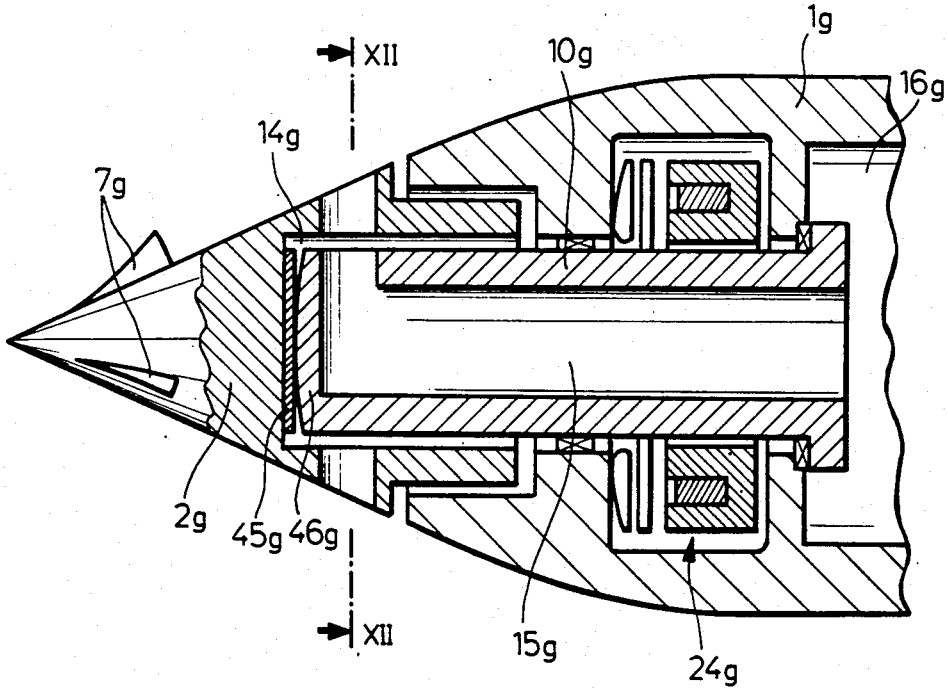
FIG. 11 is an axially extending sectional view through part of a missile tip showing another modified embodiment of the apparatus incorporating the present invention.
Figure 12:
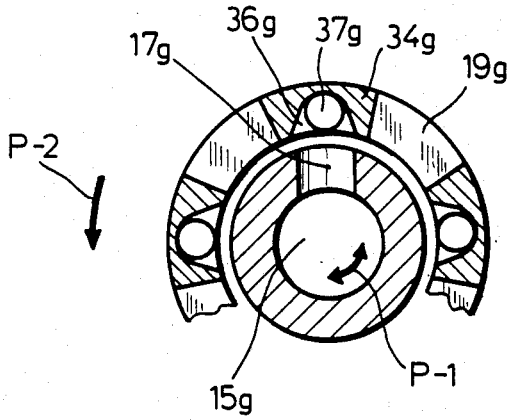
FIG. 12 is a partial transverse sectional view taken along the line XII—XII in FIG. 11.

FIG. 11 illustrates the leading end of a missile 1*g* with a rotatable missile tip 2*g*. The missile tip rotates due to the obliquely oriented fins 7g. In a manner similar to that of the embodiment in FIG. 1, a cylindrical flow means distributor 10g with a braking arrangement 24g is supported in the missile body. The flow means distributor 10g cooperates with a gas generator 16g with the gas flowing through a central gas duct 15g to a single radial nozzle 17g. A plurality of blow-out openings 19g separated from one another by webs 34g, are distributed on the circumference of the rotating missile tip in the region of the nozzle opening 17g. Each of the webs 34g has a concave recess 36g facing toward the flow means distributor 10g and a collecting duct 37g extend from the recess 36g. In this embodiment, similar to the embodiment in FIG. 7, a zero command is achieved when the nozzle 17g faces a web 34g and the exiting gas flow is guided through the collecting duct 37g and is conducted away in a directionally neutral manner.

The drive for the flow means distributor 10g is effected by the rotating missile tip itself. In addition, a friction lining 45g is provided in the base of the borehole 14g in the missile tip 2g and the friction lining 45g is located in contact with the leading end face 46g of the flow distributor means 10g. The friction between the friction lining 45g and the leading end face 46g is dimensioned so that the flow means distributor 10g is carried along by the missile tip 2g when the braking arrangement 24g is released. Accordingly, when the flow means distributor 10g is located in the position shown in FIG. 12, a zero command exists and this zero command is maintained during the continued rotation of the missile tip 2g. As soon as the braking arrangement 24g is applied, the flow means distributor remains stationary relative to the missile body or it is at least braked while the missile continues to rotate. The gas jet flowing from the nozzle 17g is then conducted through the adjacent blow-out opening 19g of the missile tip 2g. Here, as well, a fine dosing of the transverse force can be achieved with the overlap extent correspondingly adjusted between the nozzle opening 17g and the blow-out opening 19g. As soon as the desired overlapping is achieved, the braking arrangement 24g is released so that the flow means distributor 10g is carried along by the missile tip 2g. The extent of the overlapping is preferably adjusted in front of the next web 34g so that the maximum transverse force has already been exceeded. If a zero command is subsequently produced, the braking arrangement 24g is again applied and is released only when the nozzle opening 17g disappears behind the next web 34g of the missile tip.

In these embodiments an independently rotating missile tip, stable with respect to loading, is provided with blow-out openings in each instance. It is also possible, however, to permit another part of the missile to rotate instead of the missile tip, that is, a cylindrical part of the missile in the region of its trailing end is provided with the blow-out openings.

It is also possible to align the blow-out openings in the rotating part so that the transverse force, in addition to the radial component for correcting the flight path, also includes axial components for propelling the missile in the forward direction.

If the transverse force is produced by ram air, the outlet openings of the flow means distributor can be closed for a zero command. In contrast to the embodiments using the gas generator, an exhaust of the ram air is unnecessary.

It is also possible to install the described apparatus in other than a missile, such as in a self-propelled flying body for the purpose of correcting its flight path.

While specific embodiments of the invention have been shown and described in detail to illustrate the application of the inventive principles, it will be understood that the invention may be embodied otherwise without departing from such principles.

I claim:

1. An apparatus for correcting the flight path of a missile, such as a high speed projectile, comprising a missile body having a central axis and an outer circumferential surface, a flow means distributor rotatably mounted in said missile body and having at least one outlet opening for the flow means distributor for effecting a transverse force on said missile body, at least one blow-out opening in the circumferential surface of said missile body alignable with said outlet opening, and a braking means acting between said distributor and said missile body, wherein the improvement comprises that said missile body includes a missile part rotatable independently of said distributor and said missile part being stable with respect to load, means for rotating said distributor, and said at least one said outlet opening and said at least one blow-out opening being at least partially alignable in a controlled manner by said means for rotating said distributor and by said braking means.

2. An apparatus, as set forth in claim 1, wherein said means for rotating said distributor enables a rotation in the same direction with said rotating part of said missile body at a speed which is greater than the rotational speed of the independently rotatable missile part.

3. An apparatus, as set forth in claim 1 or 2, wherein said means for rotating said distributor comprises a spring drive, said rotatable missile part comprises a missile tip on said missile body, said spring drive is clamped between said missile tip and said distributor and said spring drive is tensioned during the application of said braking arrangement between said distributor and said missile body.

4. An apparatus, as set forth in claim 3, wherein said spring drive is a coil spring.

5. An apparatus, as set forth in claim 3, wherein the clamping of said spring drive is provided on said missile tip by a stop and on said spring drive by a spring stop arranged to contact said stop on said missile tip, and said spring stop can override said stop at a predetermined spring tension.

6. An apparatus, as set forth in claim 1, wherein said means for rotating said distributor comprises a friction drive which comprises a first part on said missile tip and a second part on said distributor and said friction drive is arranged so that when said braking arrangement is not applied said distributor is carried along by said rotating missile tip and when the braking arrangement is applied said distributor is braked or stopped.

7. An apparatus, as set forth in claim 1, wherein said means for rotating said distributor comprises a gas generator in said missile body and said outlet opening from said distributor being off-center with respect the central axis.

8. An apparatus, as set forth in claim 1, wherein said distributor has two outlet openings, said missile part comprises a missile tip having two blow-out openings arranged at least to partially overlap with the outlet openings, during identical overlapping of said outlet openings and said blow-out openings the resulting transverse forces add up to zero and in a change of the overlapping extent between said outlet openings and said blow-out openings when the angular position between said distributor and said missile tip is effected a transverse force is established for acting on said missile body.

9. An apparatus, as set forth in claim 1, wherein said missile part is a missile tip, stops are provided between said distributor and said missile tip for holding said distributor in a determined angular position relative to said missile tip corresponding to a zero command.

10. Apparatus, as set forth in claim 9, wherein said stops on said missile tip are constructed as spring stops for overriding said stops on said distributor during rotation of said missile tip.

11. An apparatus, as set forth in claim 9, wherein said stop on said distributor is a spring stop arranged to override a fixed said stop on said missile tip.

12. An apparatus, as set forth in claim 11, wherein said spring has a bent end forming said spring stop and is arranged to contact said stop on said missile tip and said spring is connected at its opposite end with said distributor.

13. An apparatus, as set forth in claim 1, wherein said missile part is a missile tip, said missile tip having a bore extending therethrough along the central axis thereof for directing ram air into said missile body, and for producing a transverse force on said missile body said bore in said missile tip communicates with a centrally arranged gas duct in said distributor, and said gas duct in said distributor leads to said outlet openings from said distributor.

14. An apparatus, as set forth in claim 4, wherein the relative angular position between said missile tip and said distributor is defined by said coil spring and bears against said distributor in a tensioned position and bears against said missile tip in an expanded position.

15. An apparatus, as set forth in claim 1, wherein said missile part comprises a missile tip, angle transmitters are located between said missile tip and said missile body and between said distributor and said missile body.

* * * * *